United States Patent [19]

O'Neill et al.

[11] 4,201,653

[45] May 6, 1980

[54] ELECTROWINNING CELL WITH BAGGED ANODE

[75] Inventors: Charles E. O'Neill; Victor A. Ettel, both of Mississauga; Alfredo Villazor, Fonthill; Peter G. Garritsen, Welland, all of Canada

[73] Assignee: Inco Limited, Toronto, Canada

[21] Appl. No.: 928,687

[22] Filed: Jul. 27, 1978

[30] Foreign Application Priority Data

Oct. 11, 1977 [CA] Canada ..... 288455

[51] Int. Cl.[2] ..... C25C 7/04; C25C 7/00

[52] U.S. Cl. ..... 204/263; 204/266; 204/282

[58] Field of Search ..... 204/263, 269, 282–283, 204/257, DIG. 1, 106, 112, 252, 266

[56] References Cited

U.S. PATENT DOCUMENTS

| | | | |
|---|---|---|---|
| 1,117,185 | 11/1914 | Griffin | 204/282 X |
| 2,265,645 | 12/1941 | Johnson et al. | 204/257 |
| 3,200,055 | 8/1965 | Scacciati | 204/282 X |
| 4,075,069 | 2/1978 | Shinohara et al. | 204/282 X |
| 4,087,339 | 5/1978 | Elliot et al. | 204/112 |

*Primary Examiner*—John H. Mack
*Assistant Examiner*—D. R. Valentine
*Attorney, Agent, or Firm*—L. Messulam; E. C. MacQueen

[57] ABSTRACT

A cell for electrowinning metal from a sulfate electrolyte includes insoluble anodes and cathodes, each anode being housed in an anolyte compartment defined by a flaccid sheath of porous membrane and means within each sheath for separating the sheath from the surfaces of the anode contained therein.

1 Claim, 4 Drawing Figures

ELECTROWINNING CELL WITH BAGGED ANODE

The present invention relates to a cell of improved design which is suitable for electrowinning metals such as copper, nickel and cobalt from appropriate sulfate electrolytes.

The recovery of metals such as nickel and copper by electrowinning is well known and has been practised for some time on a commercial scale. While chloride electrolytes may be employed for such electrowinning, their use involves the liberation of chlorine at the anode and necessitates elaborate cell designs to cope adequately with the chlorine. An example of such a cell design for chloride electrowinning is described and claimed in U.S. Pat. No. 3,959,111. Moreover the metals to be recovered are often readily available in the form of sulfate solutions as a result of a prior sulfuric acid leaching operation. Hence electrowinning has been most widely practised using sulfate electrolytes.

When a sulfate solution is electrolyzed, the anodic reaction is oxygen evolution and the electrolyte pH is lowered as electrowinning proceeds. To cope with this acid formation a permeable membrane, or diaphragm, is interposed between anode and cathode so as to divide the cell space into anolyte and catholyte compartments. In addition the electrolyte is fed into the cell and withdrawn from it in such a way as to maintain a catholyte to anolyte flow. The combination of the diaphragm and electrolyte flow serve to localize the pH change to the anolyte region.

The interposition of a diaphragm between anode and cathode has commonly been accomplished by enclosing each cathode with a "cathode box" which consists of a rigid frame supporting a cloth membrane. The frame serves the important function of maintaining the membrane taut to resist its tendency to bulge out towards the anode by virtue of the electrolyte flow. Despite the wide usage thereof, cathode boxes possess several inherent disadvantages, among which can be listed the following important ones.

(i) The boxes themselves represent a significant cost item in the overall process in view of their method of construction and limited life resulting from damage to the cloth membrane brought about by insertion and withdrawal of cathodes.

(ii) In order to allow for electrodeposit thickness, and minimize the risk of membrane tearing, the boxes are made to be comparatively spacious and this renders the whole cell bulky thereby limiting the number of cells which can be accommodated in a given tankhouse area.

(iii) The above-mentioned bulkiness adversely affects the process efficiency insamuch as it results in greater electrolyte resistance between the electrodes.

(iv) The electrolyte in the cell is divided into several catholyte portions and a common anolyte portion. Since local catholyte conditions, particular the pH, are critical to achieving good deposition, it is necessary to monitor and adjust these conditions and this is rendered complicated by the existence of a plurality of different compartments each requiring individual control.

Several of these disadvantages could be overcome by resorting to the practise of enveloping anodes instead of cathodes. Since the former do not grow in thickness the bulkiness can be reduced by making the boxes slimmer. Moreover since anodes do not need to be inserted and removed with each deposition cycle, damage to the cloth membrane of the box is minimized and its useful life increased. Most importantly since the cell would be divided into several anolyte compartments and a common catholyte compartment, monitoring and control of catholyte composition and pH are greatly simplified. The use of anode boxes in the context of chloride electrowinning is disclosed in the above-mentioned U.S. patent, where the boxes are an important part of the chlorine collection system. Moreover in the context of the more conventional chloride-free electrowinning, a cell including anode boxes for electrowinning chromium is described by M. J. UDY in his monograph entitled "Chromium" (Reinhold Publishing Corp, NY, 1956) at page 56. However despite the distinct advantages of using anode boxes over using cathode boxes, the conventional diaphragm box structure has remained an inconvenient and costly feature, for which no simple alternative has been successfully formulated.

It is thus an object of the invention to provide an electrowinning cell wherein conventional diaphragm boxes are replaced by simpler and more economical diaphragm means.

It is a further object of the invention to provide such a cell wherein the risk of damage to the diaphragms upon insertion and removal of electrodes is minimized.

According to the invention there is provided a cell for electrowinning a metal from a sulfate electrolyte comprising a housing within which are located a plurality of anodes insoluble in the electrolyte and a plurality of cathodes insoluble in the electrolyte and interleaved between the anodes, wherein the improvement comprises: a plurality of flaccid sheaths of porous membrane each of which is positioned relative to a respective one of the anodes to surround at least the portion thereof which in operation is immersed in the electrolyte; spacing means within each sheath to maintain a spacing between the sheath and the surfaces of its respective anode, thereby defining an anolyte compartment; and means for feeding electrolyte into the cell volume between the anolyte compartments and withdrawing electrolyte from within the anolyte compartments, whereby in operation an electrolyte flow is maintained through the sheaths into the anolyte compartments.

The term 'flaccid sheath' is used herein to describe a sleeve, whether seamed or seamless, made of any of the various known diaphragm materials. In contrast to an electrode box where the diaphragm is tautly supported by a rigid frame, the sheaths of the invention would, but for the use of any spacing element, be free to bulge outwardly or collapse inwardly under fluid flow stresses. Their use in the cell of the present invention is made possible by the fact that it is the anode and not the cathode that is housed within them. As a result the fluid flow, from cathode to anode, urges the sheath to collapse onto the anode rather than to bulge out towards adjacent cathodes. Such tendency to collapse inwardly is easily overcome by the simple expedient of positioning an appropriate spacer between the sheath and its respective anode.

The spacer in question can be made of any one of a variety of materials, the only prerequisites being low electrical conductivity and stability and inertness in the electrolyte under operational conditions. Thus natural and synthetic rubbers as well as various plastics polymers may be used for the spacer element. The shape of the latter will of course depend on the shape of the anode itself. Most commonly the anodes are in the form of sheets, for example of lead alloy, and in such a case the spacers will conveniently be in the form of foraminous, sheet-like members adjacent to the surfaces of the anode sheet. Preferably the spacer members are undulated rather than flat. Within a given sheath, the spacing means may comprise a unitary structure having a generally U-shaped cross-sectional configuration so that in operation the arms of the U are interposed between anode surface and sheath, while the trough of the U separates the lower edge of the anode from the bottom of the sheath. The porosity of the spacing element can be ensured by constructing it, for example, from perforated sheet material or from mesh-like material.

In general it will be preferable, though not essential, to have the sheath of such length that it can envelop not only the immersed portion of the anode but the whole of it. Thus the sheath can be closed at the top after inserting the anode and spacer therein, or at least folded over the top of the anode. In this way the sheath guides oxygen released as well as acid mist carried therewith into the space vertically above the anode. A hood positioned at that point and connected to a source of low pressure will effectively remove the oxygen and acid mist. Where the sheath is made to envelop the whole of the anode, provision must be made of course for passage therethrough of the electrical cross bar connected to the anode, and also for passage of anolyte out of the sheath.

As an alternative to using a sheath which totally envelope the anode, the sheath used may be in the form of a sleeve closed at one end, the opening of which is sealed to the edge of the anode hood. In this way substantially all of the submerged portion of the anode is surrounded by the sheath while the portion of the anode which is close to and above the electrolyte level is housed within the hood. With such an arrangement an outlet in the lower, submerged, part of the hood can be used to extract both anolyte and gases from the anolyte chamber.

A preferred manner of achieving the necessary electrolyte flow from cathode to anode involves the use of an electrolyte feeder and an overflow trough located on opposite sides of the cell housing from one another. The feeder communicates with the catholyte compartment, while the overflow trough communicates with the interior of the sheaths through a suitable opening in each sheath or its hood.

The anodes do not require frequent withdrawal and replacement during operation and this in itself makes anode diaphragms capable of longer life than cathode diaphragms. In any event withdrawal of anodes presents little risk of damaging the diaphragms since, unlike cathodes, the anodes remain of substantially fixed thickness. Moreover replacement of a sheath in the event of wear or damage is less costly than would be the rebuilding or replacement of a damaged anode box.

The invention will now be specifically described with reference to preferred embodiments thereof.

DETAILED DESCRIPTION OF THE EMBODIMENT

Figure 1:
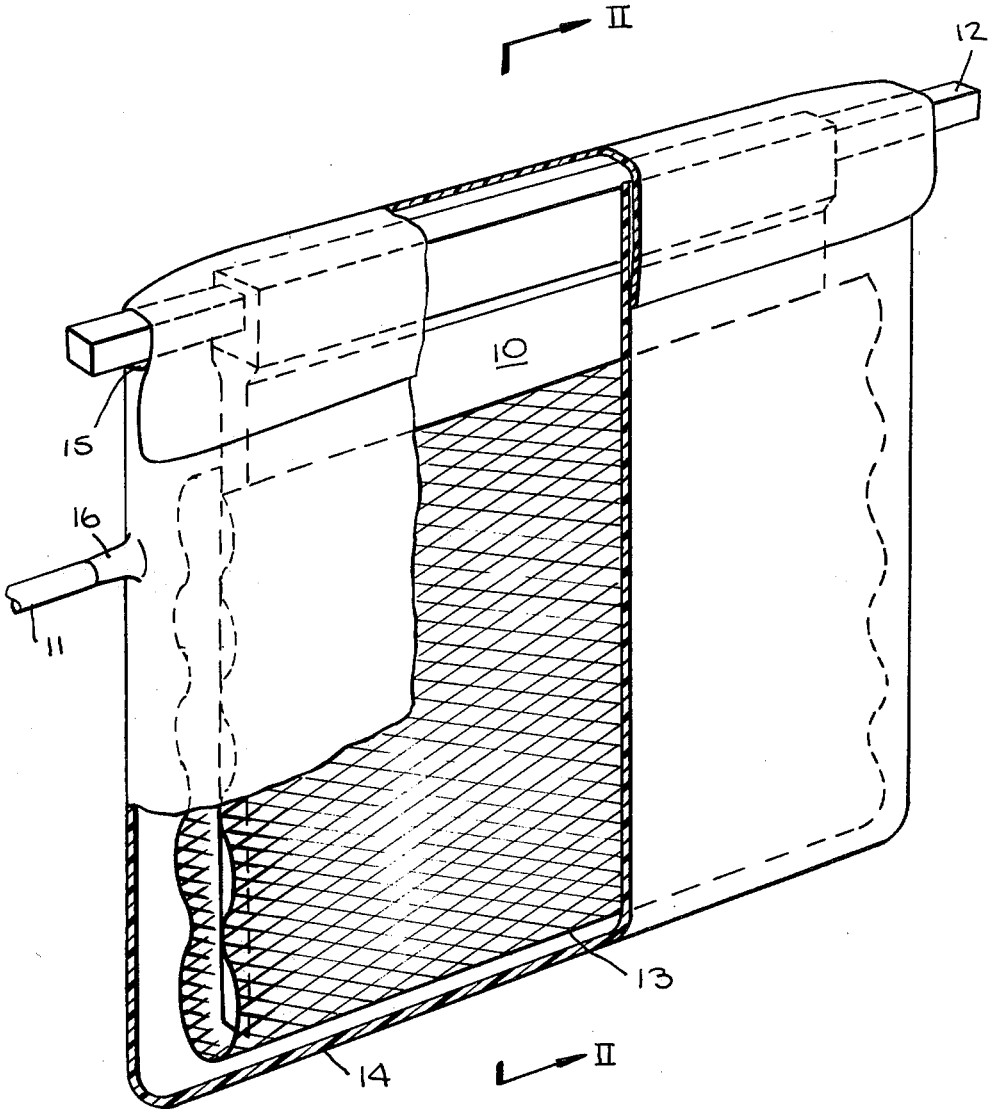
FIG. 1 of the accompanying drawings is a schematic representation of a perspective view of a sheathed anode in an embodiment of the invention.

Referring first to FIG. 1, an electrode 10 is shown which is in the form of a rectangular sheet formed with an integral copper cross-bar 12. A spacing element 13 consists of an undulating sheet of plastic mesh, folded at its center and wrapped around the lower edge of the anode. The width of the spacing element, i.e. its dimension horizontally as viewed in FIG. 1, is such that it extends past both of the vertical edges of the anode 10. The spacer is perforated to allow passage of anolyte therethrough and is constructed of a plastics polymer, e.g. polyvinyl chloride.

Enveloping the anode, cross-bar and spacer is a sheath 14, which is in the form of a sleeve open at one end thereof. The anode and spacer are inserted into the sheath through its open end, which end is then folded over the top of cross-bar leaving only a portion thereof exposed through an opening 15. The sheath has an aperture 16 in one of its vertical edges, the vertical position of this aperture being such that in use the catholyte level is above the aperture. The aperture 16 is equipped with a nipple by means which it is connected to tubing 11 which communicates with the overflow trough of the cell.

Figure 2:
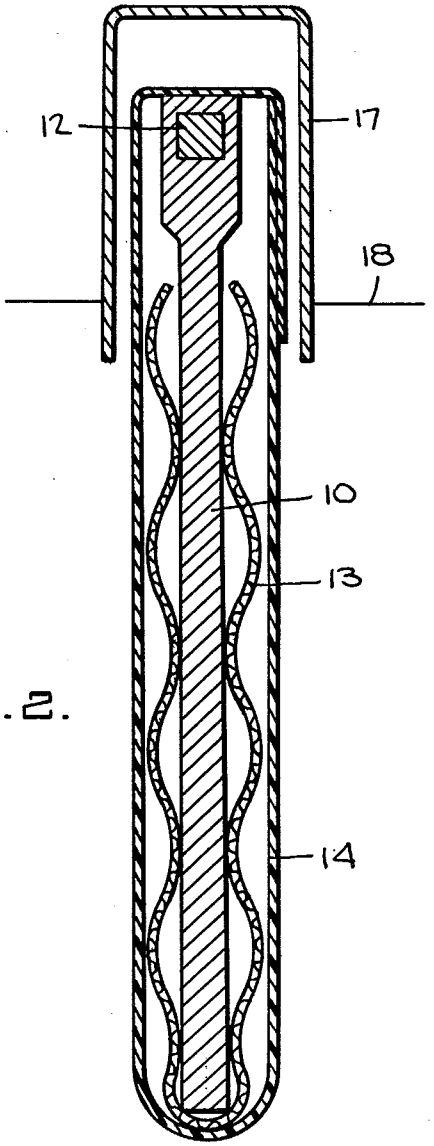
FIG. 2 is a schematic representation of the cross-sectional view of the sheathed anode of FIG. 1, along the line II—II of FIG. 1, when such anode is partially immersed in electrolyte.

Turning now to FIG. 2, a cross-sectional view of the same sheathed anode is shown, with the identical numeral being used to represent a given component in both Figures. The line 18 indicates the level at which electrolyte is maintained and as already stated this level is slightly higher than the aperture 16 shown in FIG. 1. As a result anolyte passes from the interior of the sheath, through the aperture 16, to an anolyte trough (not illustrated) with which the aperture 16 communicates, and overflows from that trough.

Also shown in FIG. 2 is a hood 17 which covers the unsubmerged part of the anode and extends slightly below the electrolyte surface. In operation oxygen released at the anode is guided up by the sheath, forced through the tortuous path where the sheath is folded over itself and exits, together with acid mist carried over, in the interior of the hood 17. From here the gases and mist can conveniently be extracted by suction means (not illustrated).

Figure 3B:
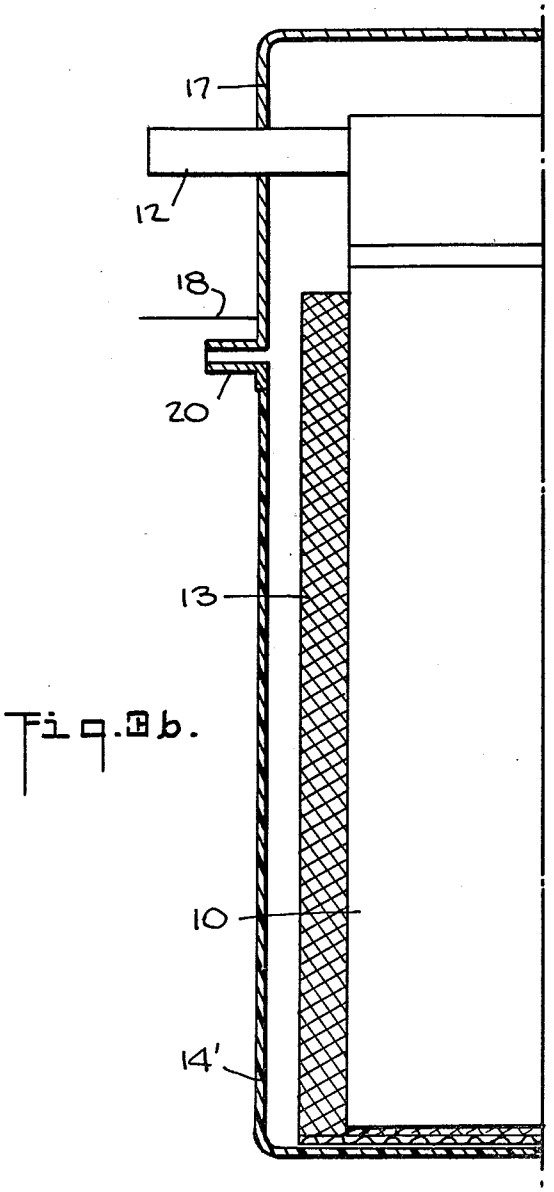
FIGS. 3(*a*) and 3(*b*) are respectively schematic representations of a cross-sectional view and a partial end view of a sheathed anode in another embodiment of the invention.
Figure 3A:
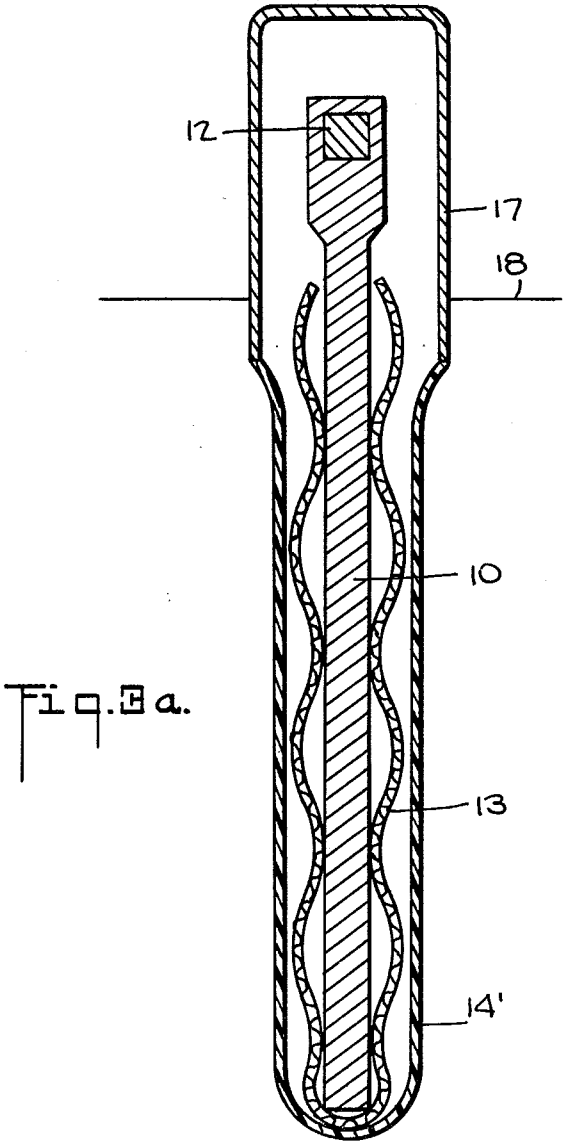

FIGS. 3(*a*) and 3(*b*) illustrate an alternative form of anode assembly in accordance with the invention. This is similar in many respects to the assembly of FIGS. 1 and 2, comprising an anode 10 provided with a cross bar 12, and flanked by a spacer assembly 13. In this case however the sheath 14' does not envelop the whole anode but only most of its submerged portion. The upper edge or mouth of the sheath is sealed to the hood 17'. The side wall of the hood terminates below the electrolyte level 18 and is provided with an opening 20 through which both electrolyte and gas exit from the anolyte compartment. This obviates the need for separate suction means to extract gases from the hood space.

While the present invention has been specifically described with reference to preferred embodiments thereof, it will be appreciated that various additions and modifications may be made to such embodiments. For example if a rod-like anode is used instead of a sheet, the sheath and spacer will of course need to be of an appropriate shape, e.g. tubular. Moreover while a unitary spacing element has been described, the spacing means within a given sheath may comprise two or more component parts. A particularly useful construction for the separator might comprise a lattice-like structure of criss-crossed perforated plastic strips. Such modifications and others are within the scope of the present invention which is defined by the appended claims.

We claim:

1. A cell for electrowinning a metal from a sulfate electrolyte comprising a housing within which are located a plurality of anodes insoluble in the electrolyte and a plurality of cathodes insoluble in the electrolyte and interleaved between the anodes, wherein the improvement comprises; a plurality of flaccid sheaths each of which comprises a sleeve-shaped porous membrane which is positioned relative to a respective one of the anodes to envelop at least the portion thereof which in operation is immersed in the electrolyte; spacing means interposed between each sheath and the surfaces of its respective anode to maintain a spacing therebetween, thereby defining an anolyte compartment; means for feeding electrolyte into the cell volume between the anolyte compartments and withdrawing electrolyte from within the anolyte compartments, whereby in operation an electrolyte flow is maintained through the sheaths into the anolyte compartments, and a plurality of hood means each of which envelops the portion of a respective anode which is unsubmerged in operation; each hood means being sealed at the lower edge thereof to a respective sheath and having an aperture located slightly below the level at which electrolyte is maintained in operation whereby electrolyte and oxygen can be extracted from the anolyte compartment through said aperture.

* * * * *